US005499083A

United States Patent [19]

Inoue et al.

[11] Patent Number: 5,499,083

[45] Date of Patent: Mar. 12, 1996

[54] DEVELOPING METHOD USING A DEVELOPING AGENT CONVEYING SLEEVE OF A SMALL DIAMETER AND TONER FOR THE DEVELOPING AGENT USED THEREFOR

[75] Inventors: Masahide Inoue; Mamoru Kato; Koichi Tsuyama; Koji Murata; Yutaka Aso, all of Osaka, Japan

[73] Assignee: Mita Industrial Co., Ltd., Osaka, Japan

[21] Appl. No.: 319,250

[22] Filed: Oct. 6, 1994

[30] Foreign Application Priority Data

Oct. 8, 1993 [JP] Japan ..... 5-253314

[51] Int. Cl.[6] ..... G03G 15/00

[52] U.S. Cl. ..... 355/251; 118/657; 355/245; 403/106.6

[58] Field of Search ..... 355/245, 251, 355/253, 259, 260; 118/653, 657, 658; 430/106.6, 110, 109, 111

[56] References Cited

U.S. PATENT DOCUMENTS

| | | | |
|---|---|---|---|
| 4,950,570 | 8/1990 | Sano et al. | 430/55 |
| 5,054,419 | 10/1991 | Itaya et al. | 118/657 |
| 5,378,572 | 1/1995 | Akiyama et al. | 430/110 |
| 5,422,214 | 6/1995 | Akiyama et al. | 430/106.6 |
| 5,429,902 | 7/1995 | Saito et al. | 430/110 |
| 5,437,954 | 8/1995 | Saito | 430/110 |

*Primary Examiner*—A. T. Grimley
*Assistant Examiner*—Thu A. Dang
*Attorney, Agent, or Firm*—Sherman and Shalloway

[57] ABSTRACT

A developing method using a compact machine such as a copying machine for personal use, etc., employs a two component-type magnetic developing agent with small diameter photosensitive drum and small diameter developing sleeve. In order to eliminate toner falling from the drum and/or sleeve to increase toner transfer efficiency and reduce fogging, the developing agent conveying sleeve is provided with a curvature ($mm^{-1}$) of from 0.2 to 0.05. The toner is specifically designed for use in the method and includes magnetic fine particles having a saturation magnetization of not smaller than 70 emu/g and hydrophobic fine silica particles added to fixing resin particles containing a coloring agent.

6 Claims, 1 Drawing Sheet

DEVELOPING METHOD USING A DEVELOPING AGENT CONVEYING SLEEVE OF A SMALL DIAMETER AND TONER FOR THE DEVELOPING AGENT USED THEREFOR

BACKGROUND OF THE INVENTION

1. Field of the Invention

The present invention relates to a developing method which uses a developing agent conveying sleeve of a small diameter and a two component-type magnetic developing agent. More specifically, the invention relates to a developing method which does not permit a toner to fall, but effects the developing maintaining good transfer efficiency of the toner and makes it possible to obtain image having little fogging.

2. Description of the Prior Art

A so-called two component-type magnetic developing agent has been extensively used for developing electrostatic image formed on an electrophotosensitive material.

The two component-type magnetic developing agent comprises a composition of a magnetic carrier such as of iron powder or ferrite particles and an electroscopic toner of a colored resin composition. To carry out the developing, the magnetic carrier and the toner are mixed together to electrically charge the toner particles to a predetermined polarity, the mixture is conveyed in the form of a magnetic brush to the photosensitive material, the surface of the photosensitive material is rubbed with the magnetic brush, whereby the electrically charged toner is adsorbed and is held by the charge image on the surface of the photosensitive material and a visible image is formed. It has also been known to externally add hydrophobic fine powdery silica to the surfaces of the toner particles to improve fluidity of the toner.

In order that the toner particles will have a predetermined polarity upon the electric charging by friction, the toner particles usually contain a charge control agent. A negatively charged toner contains a negative charge control agent such as a metal-containing complex salt dyestuff or an oxycarboxylic acid (e.g., Japanese Laid-Open Patent Publication No. 67268/1991) and a positively charged toner contains a positive charge control agent such as an oil-soluble dyestuff like Nigrosine or an amine type control agent (e.g., Japanese Laid-Open Patent Publication No. 106249/1981).

It has long been known to use a magnetic toner as the two component-type magnetic toner for developing. For instance, the above-mentioned Japanese Laid-Open Patent Publication No. 106249/1981 and Japanese Laid-Open Patent Publication No. 162563/1984 teach the use of a toner which contains a magnetic powder (toner to which a magnetic powder is internally added), and the above-mentioned Japanese Laid-Open Patent Publication No. 67268/1991 discloses a toner to which the magnetic powder is externally added, that is obtained by mixing the toner with a silica powder and a magnetic powder together.

In recent years, it has been urged to provide a photosensitive drum of a small diameter (hereinafter often called simply a small-diameter drum) and a developing agent conveying sleeve of a small diameter (hereinafter often called simply a developing sleeve) to meet the use in a copying machine for a personal use, in a small printer, in a FAX and the like that are employing a developing unit of a decreased size.

In a developing system using a drum of a small diameter and a developing sleeve of a small diameter, however, the toner falls (toner scatters) or fogging occurs conspicuously compared with when use is made of an ordinary drum and an ordinary developing sleeve.

This is because when the drum of a small diameter and the developing sleeve of a small diameter are used, the width of the developing zone formed in an area close to them inevitably becomes smaller than that of when the drum and the developing sleeve of large diameters are used, whereby the magnetic brush exhibits decreased effect of scratch off, and the effect for stirring the developing agent decreases with a decrease in the diameter of the sleeve.

SUMMARY OF THE INVENTION

The object of the present invention therefore is to provide a developing method which uses a sleeve of a small diameter, does not permit the toner to fall, but effects the developing maintaining good transfer efficiency of the toner and makes it possible to obtain image having little fogging.

According to the present invention, there is provided a developing method which uses a photosensitive drum of a small diameter, a developing agent conveying sleeve of a small diameter and a two component-type magnetic developing agent, wherein the developing agent conveying sleeve has a curvature ($mm^{-1}$) of from 0.2 to 0.05, and a toner in the two component-type magnetic developing agent is one that is obtained by externally adding magnetic fine particles having a saturation magnetization of not smaller than 70 emu/g and hydrophobic fine silica particles to fixing resin particles that contain at least a coloring agent.

According to the present invention, furthermore, there is provided a toner for a two component-type magnetic developing agent which is adapted to a developing method using a photosensitive drum of a small diameter and a developing agent conveying sleeve of a small diameter, characterized in that said toner comprises fixing resin particles which contain at least a coloring agent, and particles of an externally added agent,wherein the added agent particles comprise:

a magnetite particle which is added in amount of 0.2 to 0.6% by weight per the fixing resin particles and has a particle size of 0.1 to 1.0 μ m and a saturation magnetization of not smaller than 70 emu/g; and a hydrophobic silica particle which is added in amount of 0.2 to 0.6% by weight per the fixing resin particles and has a particle size of 1/10 to 1/30 the magnetite particle size.

DETAILED DESCRIPTION OF THE INVENTION

Figure 1:
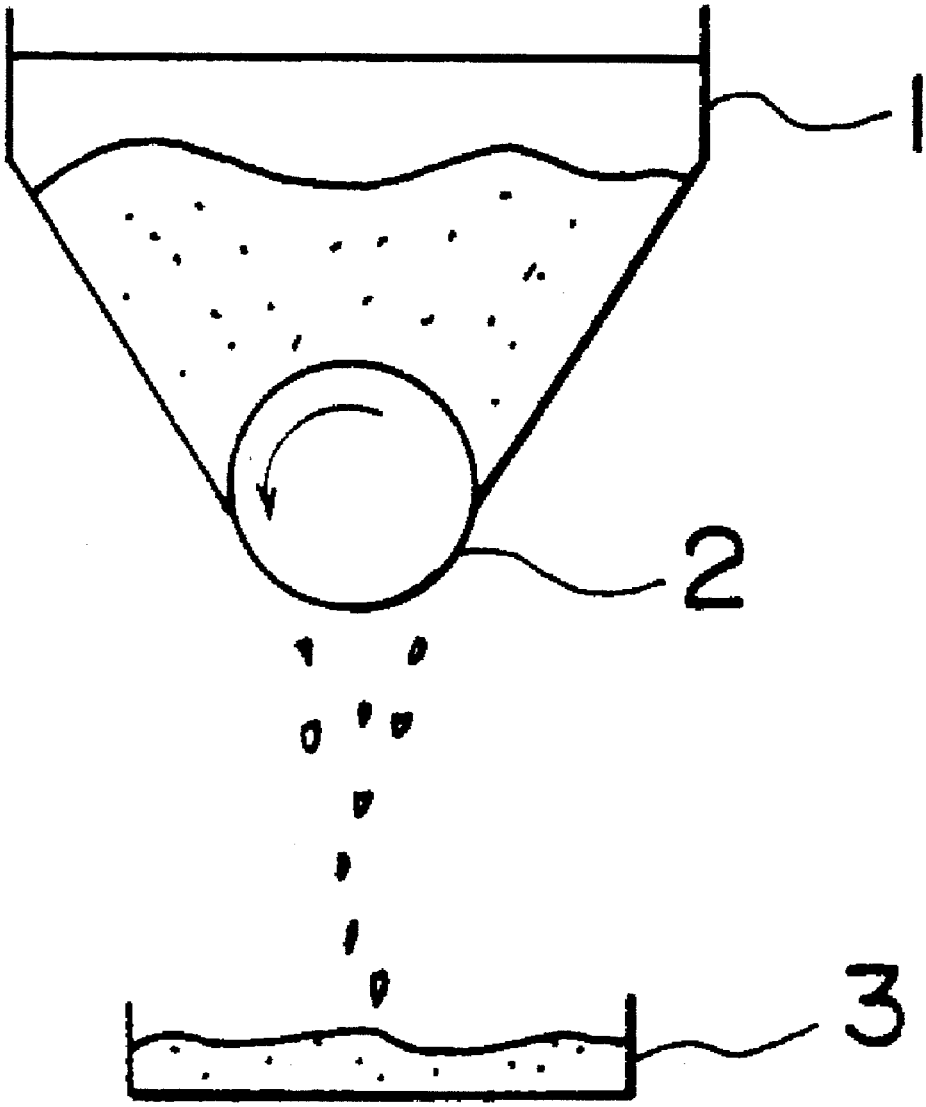
FIG. 1 is a view showing a testing machine used to measure the amount of the toner dropped in the Examples.

In the developing method using a drum of a small diameter, a developing sleeve of a small diameter and a two component-type magnetic developing agent, the toner falls and fogging occurs because of the reason that the developing sleeve of a small diameter has a short distance for conveying the developing agent and the toner tends to be insufficiently charged through the mixing of the developing agent (magnetic brush). Moreover, by using the developing sleeve of a small diameter, the width of the developing region formed relative to the drum of a small diameter tends to become narrow, and the effect of scratch-off by the magnetic brush decreases.

According to the present invention which externally adds magnetic fine particles having a saturation magnetization of not smaller than 70 emu/g and, particularly, not smaller than 75 emu/g and hydrophobic fine silica particles to the toner, it is possible to effectively prevent the toner from falling and the fogging from occurring, as well as to further enhance the transfer efficiency of the toner, despite the use of a small-diameter developing sleeve having a curvature of from 0.2 to 0.05.

Reference should be made to Examples and Comparative Examples appearing later. When a two component-type magnetic developing agent obtained by externally adding fine magnetic particles having a saturation magnetization of smaller than 70 emu/g together with hydrophobic silica to the toner is used for a small-diameter developing sleeve having a diameter of 10 mm (curvature of 0.2), the toner falls considerably and the density of fogging becomes as large as 0.009 (Comparative Example 2). On the other hand, when a two component-type magnetic developing agent obtained by externally adding a fine magnetic particles having a saturation magnetization of not smaller than 70 emu/g together with hydrophobic silica to the toner is used for a similar small-diameter developing sleeve, the toner does not fall and the density of fogging is suppressed to be not larger than 0.003. When a two component-type magnetic developing agent to which fine magnetic particles are not added is used (Comparative Example 4), the toner transfer efficiency is about 78%. In the case of the present invention, however, the transfer efficiency is improved to be not smaller than 85%.

According to the present invention which uses the toner to which are externally added magnetic fine particles having a saturation magnetization of not smaller than 70 emu/g and, particularly, not smaller than 75 emu/g, the toner does not fall even when the developing sleeve of a small diameter is used. This is presumably because of the reason that in the developing using the developing sleeve of a small diameter, bonding between the toner particles and the carrier relying upon the coulomb force becomes weak due to lack of mixing. In the present invention which externally adds fine magnetic particles having a particular saturation magnetization to the toner, however, it is considered that the toner is prevented from scattering due to the magnetic attractive force between the toner and the carrier in addition to the coulomb force between the toner and the carrier.

As the attractive force increases between the toner particles and the carrier, furthermore, the magnetic brush exhibits increased scratching effect in the developing zone and the fogging density is suppressed, as well.

When the saturation magnetization of the magnetic fine particles is smaller than the above-mentioned range, the toner is not prevented from falling and the fogging is not effectively suppressed.

In order to improve powdery fluidity, in general, a fluidity-improving agent such as fine granular silica or the like is externally added to the toner. According to the present invention, magnetic fine particles are made present in the fluidity-improving agent to weaken the bond between the toner image and the surface of the photosensitive material based upon van der Waals force, whereby the toner image can be easily peeled off and the transfer efficiency can be improved in the step of transferring toner image.

In the present invention, it is desired that the toner is externally blended with 0.2 to 0.64 by weight of magnetic fine particles and 0.2 to 0.64 by weight of hydrophobic fine silica particles with respect to the fixing resin particles (hereinafter simply called toner particles) containing at least a coloring agent.

When the amount of addition of the magnetic fine particles is smaller than the above range, sufficient effect is not obtained for suppressing the fogging and scattering of toner. When the amount of addition thereof is larger than the above range, on the other hand, scars tend to occur on the drum. When the amount of addition of the hydrophobic silica is smaller than the above range, the toner fails to exhibit sufficient fluidity. When the amount of addition thereof is larger than the above range, on the other hand, the amount of electric charge so increases that the image concentration decreases.

(Toner Particles)

In the toner in the developing agent used for the present invention, the toner particles which are the constituent components are those obtained by dispersing a coloring agent and, as required, a charge control agent and other known additive agents for the toner in the fixing resin medium. Namely, the toner particles comprise resin particles having electroscopic property, coloring property and fixing property.

As the fixing resin medium, there can be used a thermoplastic resin or a thermosetting resin in the form of an uncured product or an initial condensation product. Examples include a vinyl aromatic resin such as polystyrene, or acrylic resin, polyvinyl acetal resin, polyester resin, epoxy resin, phenol resin, petroleum resin or polyolefin resin. Among them, styrene resin, acrylic resin or styrene-acrylic copolymer resin is preferably used.

The coloring agent to be contained in the resin will be the following inorganic or organic pigment or dyestuff, which is used alone or are used in a combination of two or more kinds, though the coloring agent is in no way limited thereto only, as a matter of course. That is, carbon black such as furnace black, channel black or the like; iron black such as tri-iron tetroxide or the like; titanium dioxide of the rutile type or the anatase type; Phthalocyanine Blue; Phthalocyanine Green; cadmium yellow; molybdenum orange; Pyrazolone Red: Fast Violet B, etc.

The above-mentioned pigments are used in amounts of from 5 to 15 parts by weight and, particularly, from 8 to 12 parts by weight per 100 parts by weight of the fixing resin medium.

As the parting agent for thermal fixing, furthermore, a variety of waxes and low-molecular olefin resins can be blended in the fixing resin medium. The olefin resin should have a number average molecular weight (Mn) of from 2000 to 8000 and, particularly, from 3000 to 6000.

Examples of the olefin resin include polypropylene, polyethylene and propylene-ethylene copolymer. Among them, polypropylene is particularly preferred.

The charge control agent will be any charge control agent that has been widely known, such as oil-soluble dyes, e.g., Nigrosine Base (CI50415), Oil Black (CI20150), Spilone Black and the like, 1:1 type or 2:1 type metal complex dyestuff, metal salt of salicylic acid or a derivative thereof, metal salt of naphthenic acid, fatty acid, soap, resin acid soap, etc.

The toner particles should have an average particle size of from 5 to 20 μm and, particularly, from 8 to 16 μm, and should have such a particle size distribution that those having sizes of not larger than one-half the average particle size are not larger than 5% by weight of the whole amount. The particles may have irregular shapes as prepared by a melt-kneading pulverization method or may have a spherical shape as prepared by a dispersion or suspension polymerization method.

The toner particles used in the present invention can be prepared by a known method such as pulverization/classification method, melt-granulation method, spray-granulation method or polymerization method. However, the pulverization/classification method is generally used.

The toner particle components are pre-mixed using a mixer such as Henschel's mixer, are kneaded by using a kneader such as biaxial extruder, and the kneaded composition is cooled, pulverized and is classified to obtain a toner.

(Externally Added Agents)

In the present invention, the magnetic fine particles and the hydrophobic silica are added in combination as agents to be externally added to the toner particles.

As the magnetic fine particles, there can be used any known magnetic fine particles such as of tri-iron tetroxide ($Fe_3O_4$), iron sesquioxide ($\gamma$—$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFeO_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co), nickel powder (Ni) or the like. These magnetic fine particles must have the aforementioned saturation magnetization, as a matter of course.

The magnetic powder that is particularly suited for the object of the present invention is the fine granular tri-iron tetroxide (magnetite). The preferred magnetite has an orthooctahedral shape and a particle size of from 0.1 to 0.5 μm. The magnetite particles may be treated for their surfaces with a silane coupling agent, a titanium coupling agent or the like agent. The magnetite particles of which the surfaces are treated with the titanium coupling agent or the like agent are desired from the standpoint of resistance against environment. Furthermore, the coercive force should be from 125 Oe to 145 Oe.

The hydrophobic silica used in the present invention is obtained by treating fine silica, which is obtained by the vapor-phase method, with an organosilicon compound such as silanes like dimethyldichlorosilane or trimethylchlorosilane, and blocking silanol on the surface with an organosilane. The preparation of the fine silica by the gas phase method is carried out by high temperature (flame) hydrolysis of silicon chloride.

Therefore, the silica is highly hydrophobic compared with ordinary silica obtained by the gas phase method, and imparts excellent moisture resistance and preservation property to the toner particles. It is desired that the hydrophobic silica has a primary particle size of from 5 to 50 millimicrons and a surface area of from 50 to 400 $m^2/g$.

It is further desired that the hydrophobic fine silica particles are those of gas phase silica which is treated with a polymethyl silyl group-containing compound and have a particle size (primary particle size) of 1/10 to 1/30 the particle size of the magnetic fine particles.

The hydrophobic silica suited for the object of the present invention is available in the trade name of Cabosile TS-720 (Cabott Co.,) and Aerosil R-972 (Nippon Aerosil Co.,).

As mentioned above, 0.2 to 0.64 by weight of magnetic fine particles and 0.2 to 0.64 by weight of hydrophobic silica are externally added and are adhered to the surfaces of the toner particles.

Through this intimate mixing, it is desired that the magnetic fine particles are externally added together with the hydrophobic fine silica particles in a pre-pulverized state and that the pre-pulverized mixing ratio is generally from 1:1 to 15:1 on the weight basis. The pre-pulverization is carried out using, for example, Henschel's mixer, homomixer, ball mill, attritor or the like.

It is desired that the toner used in the present invention has a density of from 0.33 to 0.40 $g/cm^3$ and a dielectric constant of from 1 to 5.

(Two Component-Type Magnetic Developing Agent)

The two component-type magnetic developing agent used in the present invention comprises the aforementioned toner and magnetic carrier.

As the magnetic carrier, there can be used any widely known carrier such as tri-iron tetroxide, ferrite or iron powder. A magnetic carrier of the type of ferrite is particularly suited. It is desired that the magnetic carrier has an average particle size of from 50 to 150 μm and has such a particle size distribution that those having a particle size of not larger than 50 μm is from 1 to 10% by weight of the whole amount. The magnetic carrier should have a density ρ c of, generally, from 3.50 to 6.50 $g/cm^3$ and, particularly, from 4.00 to 5.50 $g/cm^3$ though it may vary depending upon the carrier concentration C/D.

It is desired that the carrier has a saturation magnetization of from 30 to 70 emu/g and, particularly, from 53 to 65 emu/g. The magnetic carrier should be a ferrite carrier satisfying the above conditions and should, particularly, be a spherical ferrite carrier. The particle size distribution satisfies the above-mentioned conditions and should be a normal distribution or a distribution close thereto. Thecarrier that is used may be the one without coating or may be the one coated with a widely known resin such as silicone resin, acrylic resin, epoxy resin or fluorine-containing resin.

The electric resistance of the ferrite carrier varies depending not only upon its chemical composition but also upon the structure of the particles, method of preparation, and the kind and thickness of the coating. In general, the ferrite carrier should have a volume resistivity of from $5\times10^8$ to $5\times10^{11}$ Ω-cm and, particularly, from $1\times10^9$ to $1\times10^{11}$ Ω-cm.

The toner weight percentage T/D in the developing agent should generally be from 3 to 8% and, particularly, from 3.5 to 7.54. Moreover, the electric resistance of the whole developing agent should be from $1\times10^9$ to $1\times10^{11}$ Ω-cm and, particularly, from $5\times10^9$ to $5\times10^{11}$ Ω-cm.

(Developing Method)

As the photosensitive material, there can be used any photosensitive material that has heretofore been used for the electrophotographic method, such as selenium photosensitive material, amorphous silicon photosensitive material, zinc oxide photosensitive material, cadmium selenide photosensitive material, cadmium sulfide photosensitive material and a variety of organic photosensitive materials.

In the present invention, it is desired to use an organic photosensitive material for electrophotography comprising an electrically conducting substrate on which an organic photosensitive layer is provided. The organic photosensitive layer may be a single-layer photosensitive plate comprising a charge-generating agent and a charge-transporting agent dispersed in a resin medium or a laminated-layer photosensitive plate comprising a charge-generating layer and acharge-transporting layer that are provided in this order or in a reverse order on the electrically conducting substrate.

Examples of the charge-generating agent include selenium, selenium-tellurium, amorphous silicon, pyrylium salt, azo pigment, disazo pigment, anthanthrone pigment, phthalocyanine pigment, indigo pigment, threne pigment, toluidine pigment, pyrazoline pigment, perylene pigment, and quinacridone pigment which can be used in one kind or being mixed together in two or more kinds, so that the absorption wavelengths lie over a desired region.

As a positive hole-transporting agent, any positive-hole transporting substance can be used such as a nitrogen-containing cyclic compound, e.g., oxadiazole compound, styryl compound, carbazole compound, organopolysilane compound, pyrazoline compound, hydrazone compound, triphenylamine compound, indole compound, oxazole compound, isooxazole compound, thiazole compound, thiazoazole compound, imidazole compound, pyrazole compound or triazole compound, or a condensed polycyclic compound.

As the electron-transporting agent, there can be used any known agent such as an electron-attracting material, e.g., benzoquinone compound, naphthoquinone compound, diphenoquinone derivative, tetracyanoethylene, tetracyanoquinodimethane or chloroanil, or these electron-attracting materials in the form of high-molecular compounds.

As the electrically conducting substrate, there can be used a variety of materials having electrically conducting property. Examples include single metals such as aluminum, copper, tin, platinum, gold, silver, vanadium, molybdenum, chromium, cadmium, titanium, nickel, indium, stainless steel, brass and the like, aswell as plastic materials on which the above metals are vaporized or laminated and glasses coated with aluminum iodide, tin oxide or indium oxide.

There can be preferably used an ordinary aluminum blank tube and, particularly, a blank tube treated with alumite such that the thickness thereof is from 1 to 50

According to the present invention, a distinguished advantage resides in the use of a drum of a small diameter. In general, the one having a curvature of from 0.2 to 0.05 can be advantageously used for the photosensitive drum.

The developing sleeve has a curvature that lies within the above-mentioned range and is made of such a material as stainless steel or aluminum. In particular, aluminum that is treated by sand-blasting is desirable from the standpoint of carrying the developing agent.

The magnetic developing poles in the developing sleeve will be of the type of four poles consisting of a pole N1 serving as a main developing pole, a pole S1 serving as an ear-cutting pole, a pole N2 serving as a pump-up pole and a pole S2 serving as a developing agent-recovering pole, or will be of the type of five poles having an additional pole for playing the role of replacing the developing agent. These magnetic developing poles are constituted by magnetic field-generating means such as permanent magnets or electromagnets.

It is desired that the main pole N1 of the magnetic developing poles has a flux density of from 600 to 1200 gausses and, particularly, from 700 to 1000 gausses from the standpoint of image quality. Flux densities of other magnetic poles are selected to be from 500 to 1000 gausses and, particularly, from 650 to 850 gausses.

It is desired that the ear-cutting mechanism isdisposed at a position between the pole S1 and the pole N1 by taking into consideration the stability with respect to error in setting the pole angle. Moreover, the length for cutting the ear will be from 0.5 to 1.8 mm and, particularly, from 0.6 to 1.6 mm though it may vary depending upon the flux density.

A DC or AC bias voltage can be applied across the developing sleeve and the conducting substrate of the photosensitive material. The bias voltage should have a peak value between a maximum potential and a minimum potential of the electrostatic latent image, and should roughly be from 60 to 90% of a difference between the maximum potential and the minimum potential. It is further allowable to apply an AC voltage and a DC voltage.

The difference in the peripheral speed between the drum and the developing sleeve should be from 30 to 600 mm/sec and, particularly, from 60 to 300 mm/sec since it affects the amount of applying the developing agent onto the developing sleeve and rubbing pressure upon the drum by the magnetic brush.

In the electrostatic photocopying method by using the toner of the present invention, the electrostatic latent image itself is formed by any known system; e.g., the photoconducting layer on the electrically conducting substrate is uniformly charged and is then exposed to image-bearing light to form an electrostatic latent image.

The electrostatic image is easily developed by bringing the magnetic brush of the two component-type magnetic developing agent into contact with the surface of the small-diameter drum. The toner image formed by developing is transferred onto the copying paper, and is brought into contact with a heating roll so as to be fixed.

The present invention will now be explained by way of Examples.

[Example 1]

| (Toner particle composition) | (parts by weight) |
|---|---|
| Fixing resin | 100 |
| Coloring agent | 10 |
| Charge control agent | 1.0 |
| Parting agent | 5.0 |

The above composition was melt-kneaded in a biaxial extruder, and the kneaded product was pulverized by a jet mill, and was classified by a pneumatic classifier to obtain toner particles having an average particle size of 10.0 μm.

On the other hand, a magnetite having a saturation magnetization of 83 emu/g and a center particle size of 0.3 μm which was treated with a titanium coupling agent, and a gaseous-method hydrophobic fine silica powder having a center particle size of 15 nm which was treated with a compound containing a polymethylsilyl group were mixed together at a weight ratio of 10:1 for one minute by using a Vitamix to obtain a pretreated magnetite.

The pretreated magnetite was added in an amount of 0.3 parts by weight to 100 parts by weight of the toner particles, followed by mixing using the Henschel's mixer for 5 minutes to obtain a toner treated with the magnetite. To the magnetite-treated toner was added 0.3 parts by weight of a hydrophobic fine silica powder having a center particle size of 15 nm, followed by mixing for 15 minutes using the Henschel's mixer to obtain a toner of the present invention.

3.5 Parts by weight of the toner and 96.5 parts by weight of the ferrite carrier (particle size of 100 μm, volume resistivity of $3\times10^9$ Ω-cm) were mixed together to prepare a two component-type developing agent, andthe image was formed by using a developing device having a developing sleeve of a curvature of 0.2 ($mm^{-1}$) and an organic photosensitive drum of a curvature of 0.0667 ($mm^{-1}$). The developing conditions were as follows:

Gap between drum and sleeve: 0.55 mm

Peripheral speed of drum: 92 mm/sec

Peripheral speed of sleeve: 272 mm/sec (rotated in a direction inverse to the drum)

Number of copies: 20,000 copies

After the formation of image is finished, the image of a third copy was measured for its image density (ID) and fogging density (FD) and was further measured for its transfer efficiency. Moreover, scattering of toner in the device and scars on the surface of the drum were evaluated by naked eyes. The amount of initial charging in the developing agent used for forming the image and the amount of the toner that fell were also measured. The results were as shown in Table 1.

The transfer efficiency and the amount of toner that fell were measured by the methods described below. Measurement of transfer efficiency:

The amount toner consumed was calculated from the amount of the toner in the toner hopper before copying and the amount of the toner in the toner hopper after copying 20,000. Then, the amount of the toner recovered from the cleaning portion during copying 20,000 sheets was measured, and the transfer efficiency was measured from the following formula.

$$\text{Transfer efficiency (\%)} = \frac{\text{(Toner consumption amount)} - \text{(Recovered amount of the toner)}}{\text{(Toner consumption amount)}} \times 100$$

Measurement of the amount of the toner that dropped:

Measured by using a toner dropping testing machine shown in FIG. 1. The toner (20 g) was thrown in the hopper 1 of the testing machine. A metallic roller 2 (diameter 20 mm, length 135 mm) which is knurled was rotated for 5 minutes, and the amount of the toner which dropped on the receiver 3 was measured. When the amount of the dropped toner is more, the flowability of the toner is better.

[Example 2]

A magnetite having a saturation magnetization of 78 emu/g and a center particle size of 0.3 μm, which was treated with a titanium-coupling agent, and a gaseous-method hydrophobic fine silica powder having a center particle size of 30 nm, which was treated with a compound containing a polymethylsilyl group, were mixed together at a weight ratio of 10:1 for one minute using the Vitamix to obtain a pretreated magnetite.

The pretreated magnetite was added in an amount of 0.3 parts by weight to 100 parts by weight of the toner particles of Example 1, followed by mixing using the Henschel's mixer for 5 minutes to obtain a toner treated with the magnetite. To the magnetite-treated toner was added 0.6 parts by weight of a hydrophobic fine silica powder having a center particle size of 30 nm, followed by mixing for 15 minutes using the Henschel's mixer to obtain a toner of the present invention.

Measurement was taken in the same manner as in Example 1 with the exception of using the above toner and the developing device having a developing sleeve of a curvature of 0.1 ($mm^{-1}$). The results were as shown in Table 1.

[Example 3]

A magnetite having a saturation magnetization of 88 emu/g and a center particle size of 1.5 μm and a hydrophobic fine silica powder having a center particle size of 150 nm were mixed together at a weight ratio of 10:1 for one minute using the Vitamix to obtain a pretreated magnetite.

The pretreated magnetite was added in an amount of 1.0 part by weight to 100 parts by weight of the toner particles of Example 1, followed by mixing using the Henschel's mixer for 5 minutes to obtain a toner treated with the magnetite. To the magnetite-treated toner was added 0.6 parts by weight of a hydrophobic fine silica powder having a center particle size of 150 nm, followed by mixing for 15 minutes using the Henschel's mixer to obtain a toner of the present invention.

Measurement was taken in the same manner as in Example 1 with the exception of using the above toner and the developing device having a developing sleeve of a curvature of 0.05 ($mm^{-1}$). The results were as shown in Table 1.

[Example 4]

A magnetite having a saturation magnetization of 73 emu/g and a center particle size of 0.1 μm and a hydrophobic fine silica powder having a center particle size of 30 nm were mixed together at a weight ratio of 10:1 for one minute using the Vitamix to obtain a pretreated magnetite.

The pretreated magnetite was added in an amount of 0.1 part by weight to 100 parts by weight of the toner particles of Example 1, followed by mixing using the Henschel's mixer for 5 minutes to obtain a toner treated with the magnetite. To the magnetite-treated toner was added 0.2 parts by weight of a hydrophobic fine silica powder having a center particle size of 30 nm, followed by mixing for 15 minutes using the Henschel's mixer to obtain a toner of the present invention.

Measurement was taken in the same manner as in Example 1 with the exception of using the above toner and the developing device having a developing sleeve of a curvature of 0.2 ($mm^{-1}$). The results were as shown in Table 1.

[Example 5]

A magnetite having a saturation magnetization of 105 emu/g and a center particle size of 1.0 μm and a hydrophobic fine silica powder having a center particle size of 100 nm were mixed together at a weight ratio of 10:1 for one minute using the Vitamix to obtain a pretreated magnetite.

The pretreated magnetite was added in an amount of 0.6 parts by weight to 100 parts by weight of the toner particles of Example 1, followed by mixing using the Henschel's mixer for 5 minutes to obtain a toner treated with the magnetite. To the magnetite-treated toner was added 0.6 parts by weight of a hydrophobic fine silica powder having a center particle size of 100 nm, followed by mixing for 15 minutes using the Henschel's mixer to obtain a toner of the present invention.

Measurement was taken in the same manner as in Example 1 with the exception of using the above toner and the developing device having a developing sleeve of a curvature of 0.05 ($mm^{-1}$). The results were as shown in Table 1.

[Example 6]

A magnetite having a saturation magnetization of 88 emu/g and a center particle size of 1.0 μm and a hydrophobic fine silica powder having a center particle size of 200 nm were mixed together at a weight ratio of 10:1 for one minute using the Vitamix to obtain a pretreated magnetite.

The pretreated magnetite was added in an amount of 0.6 parts by weight to 100 parts by weight of the toner particles of Example 1, followed by mixing using the Henschel's mixer for 5 minutes to obtain a toner treated with the magnetite. To the magnetite-treated toner was added 0.8 parts by weight of a hydrophobic fine silica powder having a center particle size of 200 nm, followed by mixing for 15 minutes using the Henschel's mixer to obtain a toner of the present invention.

Measurement was taken in the same manner as in Example 1 with the exception of using the above toner and the developing device having a developing sleeve of a curvature of 0.05 ($mm^{-1}$). The results were as shown in Table 1.

[Comparative Example 1]

A magnetite having a saturation magnetization of 73 emu/g and a center particle size of 0.1 μm, which was treated with a titanium coupling agent, and a gaseous-method hydrophobic fine silica powder having a center particle size of 30 nm, which was treated with a compound containing a polymethylsilyl group, were mixed together at a weight ratio of 10:1 for one minute using the Vitamix to obtain a pretreated magnetite.

The pretreated magnetite was added in an amount of 0.2 parts by weight to 100 parts by weight of the toner particles of Example 1, followed by mixing using the Henschel's mixer for 5 minutes to obtain a toner treated with the magnetite. To the magnetite-treated toner was added 0.2 parts by weight of a hydrophobic fine silica powder having a center particle size of 30 nm, followed by mixing for 15 minutes using the Henschel's mixer to obtain a toner.

Measurement was taken in the same manner as in Example 1 with the exception of using the above toner and the developing device having a developing sleeve of a curvature of 0.25 ($mm^{-1}$). The results were as shown in Table 1.

[Comparative Example 2]

A magnetite having a saturation magnetization of 55 emu/g and a center particle size of 0.1 μm, which was treated with a titanium coupling agent, and a gaseous-method hydrophobic fine silica powder having a center particle size of 80 nm, which was treated with a compound containing a polymethylsilyl group, were mixed together at a weight ratio of 10:1 for one minute using the Vitamix to obtain a pretreated magnetite.

The pretreated magnetite was added in an amount of 0.2 parts by weight to 100 parts by weight of the toner particles of Example 1, Followed by mixing using the Henschel's mixer for 5 minutes to obtain a toner treated with the magnetite. To the magnetite-treated toner was added 0.2 parts by weight of a hydrophobic fine silica powder having a center particle size of 80 nm, followed by mixing for 15 minutes using the Henschel's mixer to obtain a toner.

Measurement was taken in the same manner as in Example 1 with the exception of using the above toner and the developing device having a developing sleeve of a curvature of 0.2 ($mm^{-1}$). The results were as shown in Table 1.

[Comparative Example 3]

A magnetite having a saturation magnetization of 73 emu/g and a center particle size of 0.1 μm and a hydrophobic Fine silica powder having a center particle size of 10 nm were mixed together at a weight ratio of 10:1 for one minute using the Vitamix to obtain a pretreated magnetite.

The pretreated magnetite was added in an amount of 0.2 parts by weight to 100 parts by weight of the toner particles of Example 1, followed by mixing using the Henschel's mixer for S minutes to obtain a toner treated with the magnetite. To the magnetite-treated toner was added 0.1 part by weight of a hydrophobic fine silica powder having a center particle size of 10 nm, followed by mixing for 15 minutes using the Henschel's mixer to obtain a toner.

Measurement was taken in the same manner as in Example 1 with the exception of using the above toner and the developing device having a developing sleeve of a curvature of 0.02 ($mm^{-1}$). The results were as shown in Table 1.

[Comparative Example 4]

A hydrophobic fine silica powder having a center particle size of 30 nm was added in an amount of 0.3 parts by weight to 100 parts by weight of the toner particles of Example 1, followed by mixing using the Henschel's mixer for 20 minutes to obtain a toner.

Measurement was taken in the same manner as in Example 1 with the exception of using the above toner and the developing device having a developing sleeve of a curvature of 0.1 ($mm^{-1}$). The results were as shown in Table 1.

TABLE 1

| | | $Fe_3O_4$ (magnetite) | | | Fine powdery silica | | Evaluation | | | | | | |
|---|---|---|---|---|---|---|---|---|---|---|---|---|---|
| | Curvature of sleeve | Saturation magnetization (emu/g) | Particle size (um) | Amount added (%) | Particle size (um) | Amount added (%) | ID | FD | Transfer efficiency (%) | Scattering toner | Amount of charge (uc/g) | Amount drapped (g/5 min) | Total judgement |
| Examples | | | | | | | | | | | | | |
| 1 | 0.2 | 83 | 0.3 | 0.3 | 15 | 0.33 | 1.425 | 0.003 | 85 | none | 24.8 | 4.4 | ⊙ |
| 2 | 0.1 | 78 | 0.3 | 0.3 | 30 | 0.63 | 1.404 | 0.001 | 88 | none | 25.3 | 4.7 | ⊙ |
| 3 | 0.05 | 88 | 1.5 | 1.0 | 150 | 6.1 | 1.288 | 0.000 | 89 | none | 34.6 | 4.8 | ○ |
| 4 | 0.2 | 73 | 0.1 | 0.1 | 30 | 0.21 | 1.487 | 0.005 | 85 | none | 19.4 | 4.1 | ○ |
| 5 | 0.05 | 105 | 1.0 | 0.6 | 100 | 0.66 | 1.313 | 0.001 | 88 | none | 26.9 | 4.5 | ○ |
| 6 | 0.05 | 88 | 1.0 | 0.6 | 200 | 0.86 | 1.276 | 0.001 | 86 | none | 32.8 | 5.0 | ○ |
| Comp. Examples | | | | | | | | | | | | | |
| 1 | 0.25 | 73 | 0.1 | 0.2 | 30 | 0.22 | 1.456 | 0.008 | 79 | large | 20.3 | 4.1 | X |
| 2 | 0.2 | 55 | 0.1 | 0.2 | 30 | 0.22 | 1.470 | 0.009 | 76 | large | 21.7 | 4.2 | X |
| 3 | 0.02 | 73 | 0.1 | 0.2 | 10 | 0.22 | 1.446 | 0.006 | 84 | little | 21.0 | 3.3 | X |
| 4 | 0.1 | — | — | — | 30 | 0.3 | 1.469 | 0.009 | 78 | large | 22.5 | 4.5 | X |

Note)
⊙: Very excellent developing method in every respect.
○: Developing method without any problem in practice.
X: Developing method involving problem in practice.

We claim:

1. A developing method which uses a photosensitive drum of a small diameter, a developing agent conveying sleeve of a small diameter and a two component-type magnetic developing agent, wherein the developing agent conveying sleeve has a curvature ($mm^{-1}$) of from 0.2 to 0.05, and a toner in the two component-type magnetic developing agent is one that is obtained by externally adding magnetic fine particles having a saturation magnetization of not smaller than 70 emu/g and hydrophobic fine silica particles to fixing resin particles that contain at least a coloring agent.

2. A developing method according to claim 1, wherein the magnetic fine particles and the hydrophobic fine silica particles are externally added in an amount of from 0.2 to 0.6% by weight and in an amount of from 0.2 to 0.6% by weight, respectively, with respect to the fixing resin particles.

3. A developing method according to claim 1, wherein the magnetic fine particles comprise a magnetite treated with a titanium coupling agent and have a particle size of from 0.1 to 1 μm.

4. A developing method according to claim 1, wherein the hydrophobic fine silica particles are those of gas phase silica which is treated with a polymethyl silyl group-containing compound and has a particle size (primary particle size) of 1/10 to 1/30 the particle size of the magnetic fine particles.

5. A developing method according to claim 1, wherein the magnetic fine particles are those that are externally added together with the hydrophobic fine silica particles in a pre-pulverized state.

6. A toner for a two component-type magnetic developing agent which is adapted to a developing method using a photosensitive drum of a small diameter and a developing agent conveying sleeve of a small diameter, characterized in that said toner comprises fixing resin particles which contain at least a coloring agent, and particles of an externally added agent, wherein the added agent particles comprise:

a magnetite particle which is added in amount of 0.2 to 0.6% by weight per the fixing resin particles and has a particle size of 0.1 to 1.0 μm and a saturation magnetization of not smaller than 70 emu/g; and a hydrophobic silica particle which is added in amount of 0.2 to 0.6% by weight per the fixing resin particles and has a particle size of 1/10 to 1/30 the magnetite particle size.

* * * * *